US008905733B2

(12) United States Patent
Guidry, Jr.

(10) Patent No.: US 8,905,733 B2
(45) Date of Patent: Dec. 9, 2014

(54) PROGRESSING CAVITY PUMP/MOTOR

(75) Inventor: Michael Guidry, Jr., Hockley, TX (US)

(73) Assignee: Robbins & Myers Energy Systems L.P., Willis, TX (US)

( * ) Notice: Subject to any disclaimer, the term of this patent is extended or adjusted under 35 U.S.C. 154(b) by 522 days.

(21) Appl. No.: 13/082,210

(22) Filed: Apr. 7, 2011

(65) Prior Publication Data

US 2012/0258001 A1 Oct. 11, 2012

(51) Int. Cl.

| | |
|---|---|
| ***F01C 1/10*** | (2006.01) |
| ***F03C 2/00*** | (2006.01) |
| ***F03C 4/00*** | (2006.01) |
| ***F04C 2/00*** | (2006.01) |
| ***F01C 19/00*** | (2006.01) |
| ***F04C 15/00*** | (2006.01) |
| ***F04C 2/107*** | (2006.01) |
| ***F04C 13/00*** | (2006.01) |

(52) U.S. Cl.

CPC ..... *F01C 19/005* (2013.01); *F04C 2210/24* (2013.01); *F04C 15/0019* (2013.01); *F04C 2/1075* (2013.01); *F04C 2/1073* (2013.01); *F04C 13/001* (2013.01)

USPC ..... 418/48; 418/152

(58) Field of Classification Search

USPC ..... 418/48, 152

See application file for complete search history.

(56) References Cited

U.S. PATENT DOCUMENTS

| | | | | |
|---|---|---|---|---|
| 6,102,681 | A * | 8/2000 | Turner | 418/48 |
| 6,120,267 | A | 9/2000 | Cunningham | |
| 6,491,501 | B1 | 12/2002 | Wild et al. | |
| 6,695,060 | B1 | 2/2004 | Guidry, Jr. et al. | |
| 6,716,008 | B1 * | 4/2004 | Kachele | 418/48 |
| 7,214,042 | B2 | 5/2007 | Parrett | |
| 7,407,372 | B2 | 8/2008 | Guidry et al. | |
| 7,553,139 | B2 | 6/2009 | Amurgey et al. | |
| 7,837,451 | B2 | 11/2010 | Wiedenhoefer et al. | |
| 8,033,802 | B2 * | 10/2011 | Tekneyan et al. | 418/48 |
| 2007/0059191 | A1 * | 3/2007 | Kreidl et al. | 418/48 |
| 2009/0074599 | A1 * | 3/2009 | Tekneyan et al. | 418/48 |
| 2009/0169404 | A1 * | 7/2009 | Sindt et al. | 418/48 |
| 2009/0220369 | A1 * | 9/2009 | Wiedenhoefer et al. | 418/48 |
| 2010/0316518 | A1 | 12/2010 | Guidry, Jr. | |
| 2010/0322808 | A1 | 12/2010 | Guidry, Jr. | |
| 2011/0150685 | A1 * | 6/2011 | Wilbourn et al. | 418/48 |
| 2012/0156078 | A1 * | 6/2012 | Guidry, Jr. | 418/48 |

* cited by examiner

*Primary Examiner* — Theresa Trieu

(74) *Attorney, Agent, or Firm* — Streets & Steele; Patrick K. Steele; Jeffrey L. Streets

(57) ABSTRACT

A progressing cavity pump/motor includes a stator (12) having a metal interior surface (14) and one or more spiraling internal lobes (16). The rotor (18) has a metal exterior surface (20) and one or more spiraling external lobes (22) for cooperating with the stator to form progressing cavities between the stator and the rotor during rotation of the rotor. At least one of the stator interior surface and the rotor exterior surface include a plurality of spaced grooves (30) in the respective surface, such that fluid flowing to a gap between the stator and the rotor is disrupted by the spaced grooves to reduce fluid leakage between the stator and the rotor.

18 Claims, 11 Drawing Sheets

PROGRESSING CAVITY PUMP/MOTOR

FIELD OF THE INVENTION

The present invention relates to a progressing cavity pump/motor, and more particularly to a progressing cavity pump/motor suitable for high temperature applications wherein both the interior surface of the stator and the exterior surface of the rotor are formed from a substantially rigid material.

BACKGROUND OF THE INVENTION

Progressing cavity pumps are used in various applications, including downhole oilfield applications to pump fluids to the surface. Progressing cavity downhole motors are similar tools commonly used to convert hydraulic energy into mechanical energy, e.g., to rotate a drill bit. The interior surface of the stator is typically formed from an elastomeric material which acts as a contact seal with the rotor. The contact areas determine the perimeter of the cavities which contain the working fluid, and these cavities progress from one end of the pump/motor to the other end of the pump/motor during its operation.

In certain applications, the operational temperature range intended for the pump/motor exceeds the practical maximum temperature of elastomeric materials or the corresponding adhesive. Materials, both elastomeric and rigid, have been used for both the surface of the rotor and the stator subjected to these conditions. For rigid material applications, a clearance between the rotor and the stator replaces the contact seal between the two parts formed in other applications when using an elastomeric seal. The clearance between the rotor and stator is either designed, or worn into the rotor and/or stator during operation. Such a design can significantly reduce the efficiency due to the volume of the working fluid passed between the I.D. of the stator and the O.D. of the rotor. Such pump/motor designs are not favored in most applications because of their poor efficiency.

Progressing cavity pump/motors are disclosed in U.S. Pat. Nos. 6,120,267, 6,491,501, 6,695,060, 7,214,042, 7,407,372, 7,553,139, and Publications US 2010/0316518 and US 2010/0322808. Such pumps conventionally contain an elastomeric layer on the inner surface of the stator for deforming during rotation of the rotor to form a contact seal. U.S. Pat. No. 7,837,451 discloses a rotor with lobes and grooves in the casing for use in pulse detonation combustors (PDC's) and engines (PDE's). Grooves are provided on a tip portion of the lobes and presumably increase air pressure to the combustion chamber. Pumps and motors according to the present invention rely upon a working fluid, which conventionally is a mixture of liquids, solids, and often some gas, to generate energy or to transfer fluids.

The disadvantages of the prior art are overcome by the present invention, an improved pump/motor is hereinafter disclosed.

SUMMARY OF THE INVENTION

In one embodiment, a progressing cavity pump/motor includes a stator having an interior surface and two or more spiraling internal lobes. The rotor has an exterior surface and one or more spiraling external lobes, with the rotor cooperating with the stator to form progressing cavities between the stator and the rotor during rotation of the rotor. At least one of the stator interior surface and the rotor exterior surface has a plurality of spaced grooves in its surface, such that fluid flowing to a gap between the stator and the rotor is disrupted by the spaced grooves to reduce leakage between the stator and the rotor.

These and further features and advantages of the present invention will become apparent from the following detailed description, wherein reference is made to the figures in the accompanying drawings.

DETAILED DESCRIPTION OF PREFERRED EMBODIMENTS

The substantially rigid stator interior surface and rotor exterior surface in a progressing cavity pump/motor incorporate a clearance or gap between the rotor and the stator surfaces. This clearance allows the rotor to turn inside the stator. The clearance is large enough to allow small solid particles, sometimes carried in the working fluid, to pass through without binding the rotor and the stator. Flow resistance through the non-contact seal formed by the gap between the rotor and the stator is created by choke flow wherein the fluid particles cannot move around each other. The present invention significantly increases the effective flow resistance of this non-contact seal, thereby significantly decreasing fluid loss between the rotor and the stator while there is a nominal gap between the rotor and the stator.

Those skilled in the art appreciate that the seal line between the rotor and the stator is moving in a cyclical manner as the pump/motor operates. The velocity and direction of flow at any point on the rotor or stator surface is therefore constantly changing in a repeating pattern. Near surface flow will be substantially parallel to the stator or rotor surface, but, at locations near the seal line, the flow can impinge at angles approaching perpendicular. This rapid cyclical velocity offers a certain amount of resistance when the rotor and stator surfaces approach each other. This resistance is minimized, however, by the conventional smooth, contoured surface on both the rotor and the stator surfaces.

The present invention incorporates small and preferably parallel grooves on the surface of either the rotor and/or the stator to create turbulent eddies in the near surface flow. This substantially increases turbulence, which results in an increase in flow resistance and thus a significant decrease in fluid leakage. The groove design (shape, depth, spacing between grooves, and orientation) determines the amount of flow resistance achieved. Eddies are created by "tripping" fluid flowing along the contoured surface as it flows across the groove, or by redirecting fluid that impinges the groove from oblique angles. As discussed hereafter, turbulence generation may be increased with the addition of steps, walls between closely spaced grooves, and a combination of walls and steps.

Figure 1:
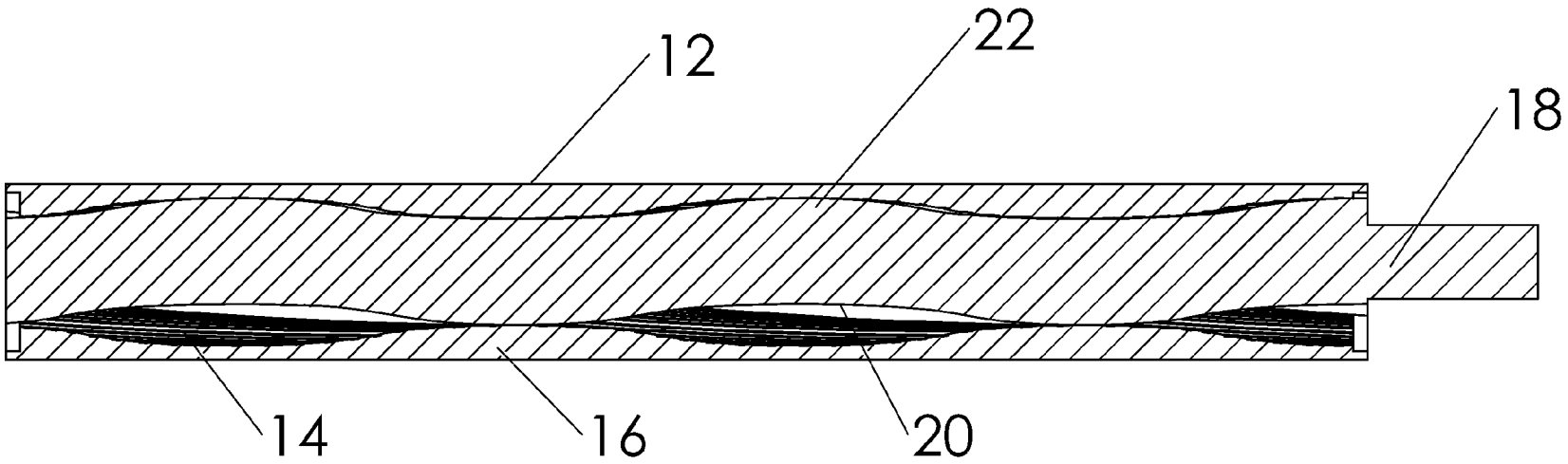
FIG. 1 is a cross-sectional view of a stator and a rotor according to the present invention.

Referring now to FIG. 1, the progressing cavity pump/motor includes a stator 12 having an internal surface 14 and two or more spiraling lobes 16. The rotor 18 includes an exterior surface 20 and one less lobe 22 than the stator, thereby forming progressing cavities between the rotor and the stator as the rotor rotates within the stator. A progressing cavity pump/motor as shown in FIG. 1 may thus be used as a pump which may be powered by a work string from the surface to pump fluids to the surface for hydrocarbon recovery, or may be used as a motor which is powered by hydraulic fluid pumped down to the motor and used to perform a mechanical function, such as rotating a shaft which then drives a drill bit. As suggested above, the vast majority of downhole motors/pumps of a progressing cavity type include a metal stator body, an elastomeric layer on the interior surface of the metal stator body, and a metal rotor which rotates and forms a contact seal with the elastomeric layer as the rotor rotates with respect to the stator. The same type of motor/pumps are sometimes operated, at a greatly reduced efficiency, with a clearance between the rotor and stator.

Figure 2:
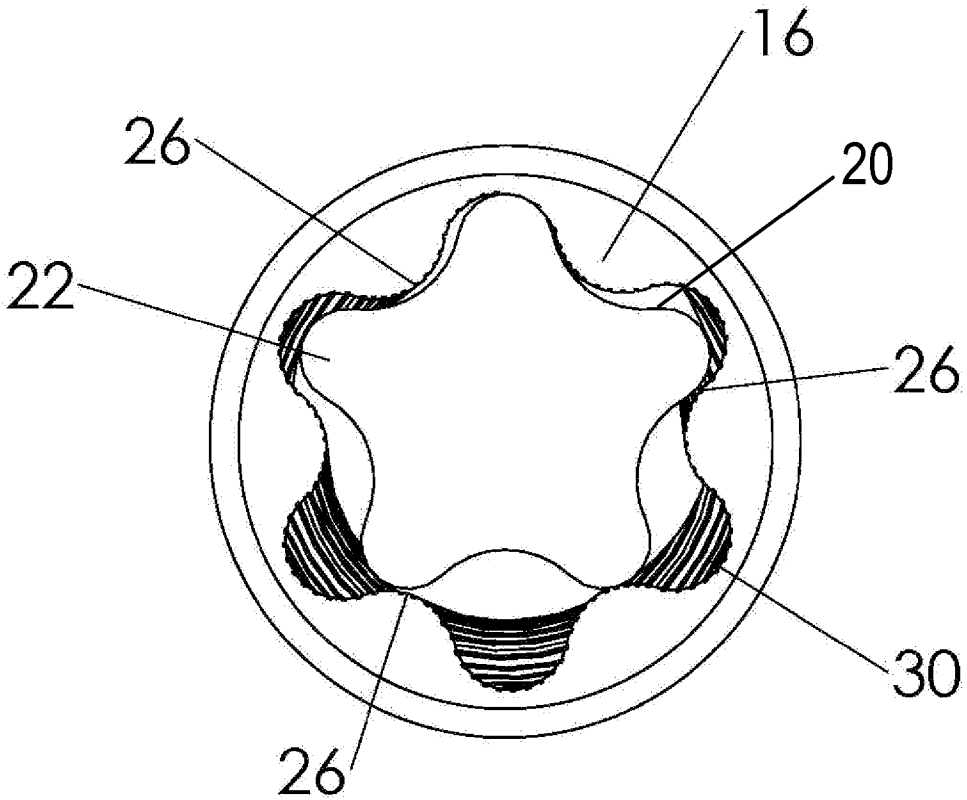
FIG. 2 is a detailed cross-sectional view of a portion of the pump/motor shown in FIG. 1 with grooves formed in the exterior surface of the stator and a gap between the stator and the rotor.

The present invention is substantially different in that the primary sealing mechanism is non-contact with grooves specifically designed to increase motor/pump efficiency. FIG. 2 illustrates a plurality of locations 26 where the rotor surface approaches the stator surface. Each location is a part of the seal area including at least one groove in the inner surface of the stator and/or in the outer surface of the rotor, as explained further below. Some fluid will leak between the rotor and the stator. The amount depends on the viscosity and velocity of the working fluid, the size of the gap, and the number and type of grooves 30. The grooves 30 provide a significant resistance to the flow moving toward and through the gap by generating disturbances which convert kinetic energy into heat, thereby significantly reducing the amount of fluid which passes through the gap and increasing the efficiency of the pump/motor.

Figure 3:
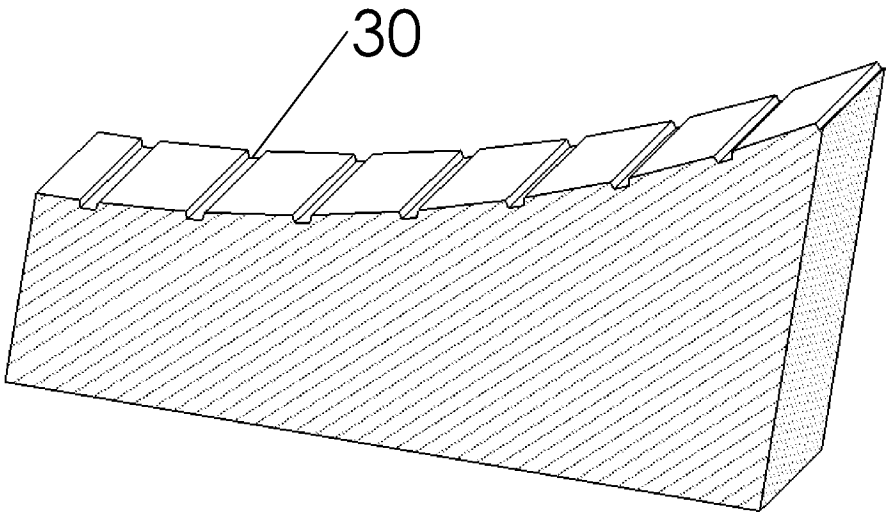
FIG. 3 is a cross-sectional view of a portion of a stator illustrating axially spaced grooves.

FIG. 3 illustrates the portion of a stator 12 with a series of rectangular-shaped elongate grooves 30 with sidewalls generally perpendicular to the groove surface. Those skilled in the art should understand that the grooves preferably extend through substantially the length of the stator, and also are preferably aligned with a centerline of one of the stator lobes. The seal location between the rotor and the stator is constantly changing, but the spaced grooves 30 as shown in FIG. 3 provide a significant disturbance to fluid flow to reduce the fluid loss and increase pump efficiency.

Figure 4:
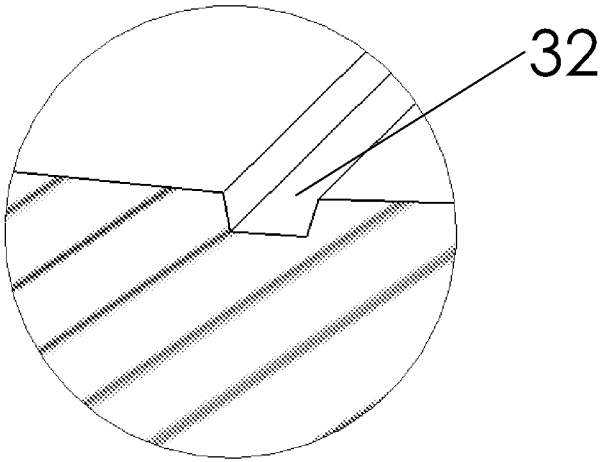
FIG. 4 is an enlarged view of alternative grooves.
Figure 5:
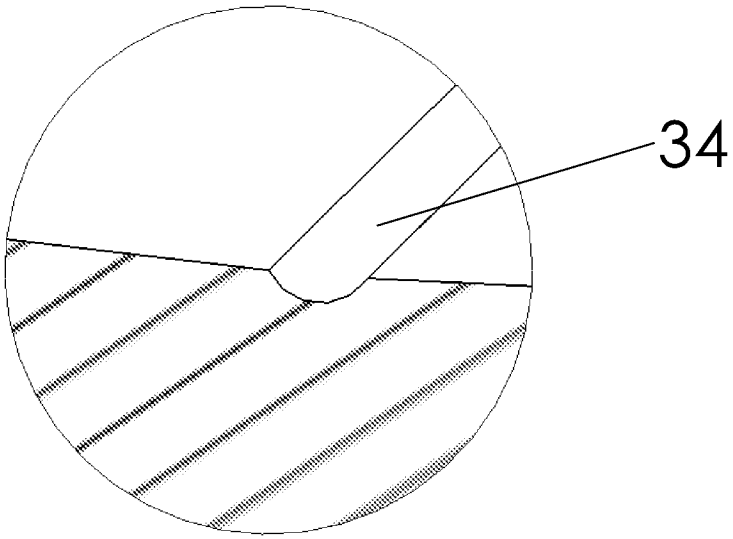
FIG. 5 illustrates yet another groove configuration.
Figure 6:
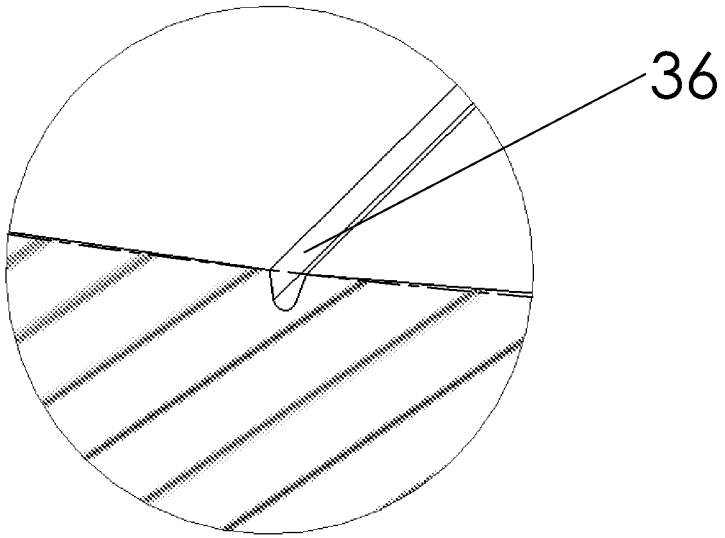
FIG. 6 illustrates alternative deeper and narrower grooves than shown in FIG. 5.
Figure 7:
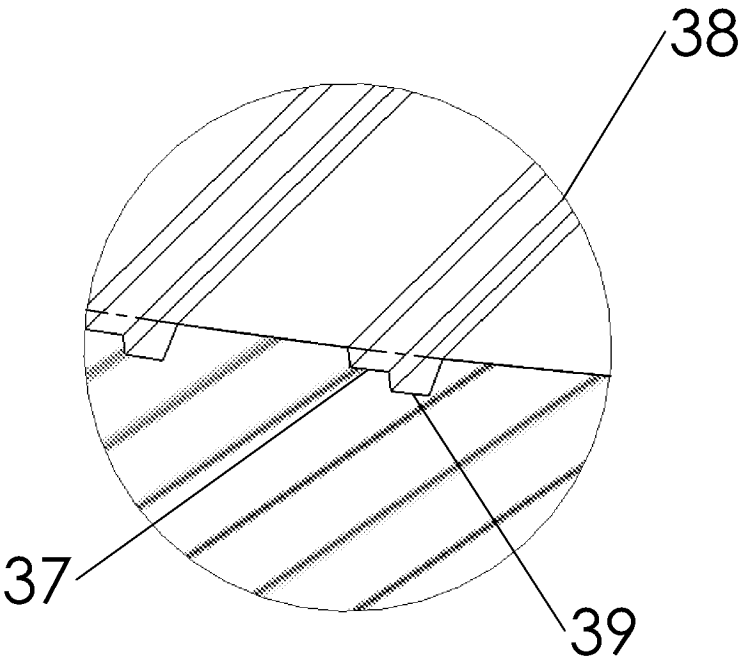
FIG. 7 illustrates a stepped grooves within the stator surface.

FIG. 4 is an enlargement of a variation of the grooves shown in the FIG. 3, and illustrates a generally rectangular groove configuration with slanted sidewalls, so that the entrance to the groove 32 is wider than the base of the groove. FIG. 5 illustrates another type of groove formed in the inner surface of the stator, with this groove 34 having a generally curved or arcuate cross-sectional configuration. The groove 36 in FIG. 6 is similar to the FIG. 5 groove, although the groove width is decreased and the groove depth is increased. FIG. 7 illustrates a stepped groove design, wherein one portion 37 of the groove 38 has a shallower depth than an adjacent portion 39 of the same groove 38.

Figure 8:
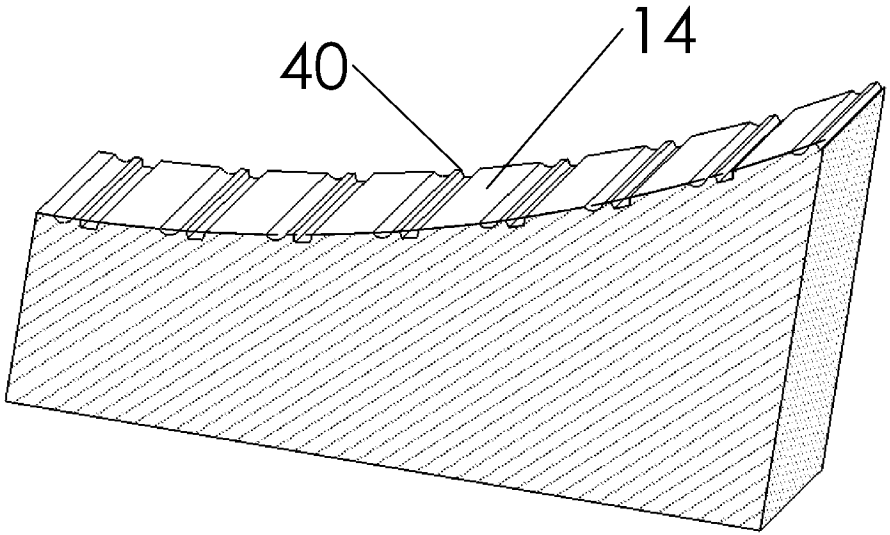
FIG. 8 illustrates a portion of a stator with sets of spaced grooves.
Figure 9:
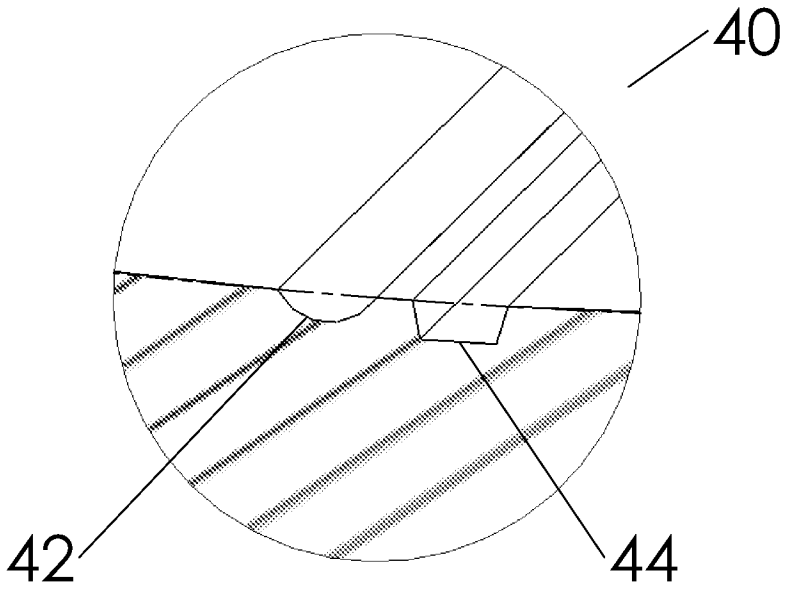
FIG. 9 illustrates in more detail the grooves shown in FIG. 8.
Figure 10:
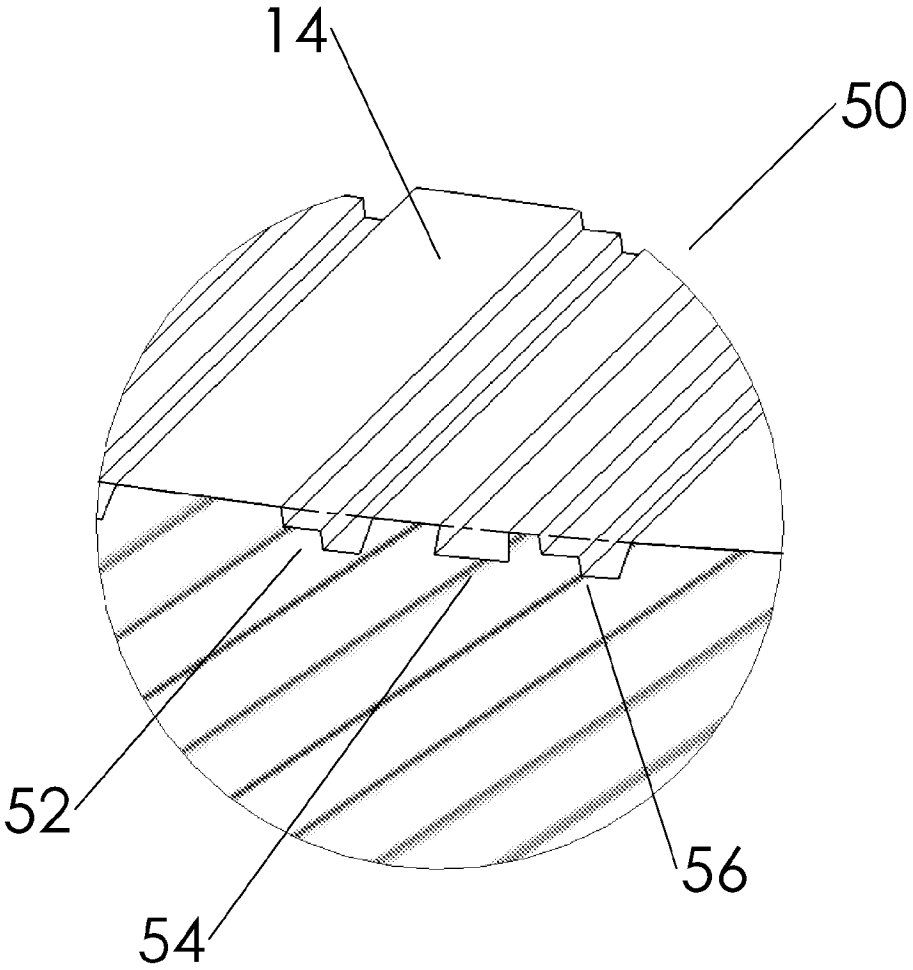
FIG. 10 illustrates a three-groove set and a series of spaced grooves.

FIG. 8 illustrates an alternative portion of a stator 12, and again only an axially short portion of the grooves are shown for clarity. The grooves in FIG. 8 are provided in sets 40, with a stator interior surface 14 spaced between each groove set. FIG. 9 is an enlargement of one of the groove sets 40 shown in FIG. 8, and illustrates the groove set comprising an arcuate groove 42 followed by a generally rectangular groove 44.

Figure 11:
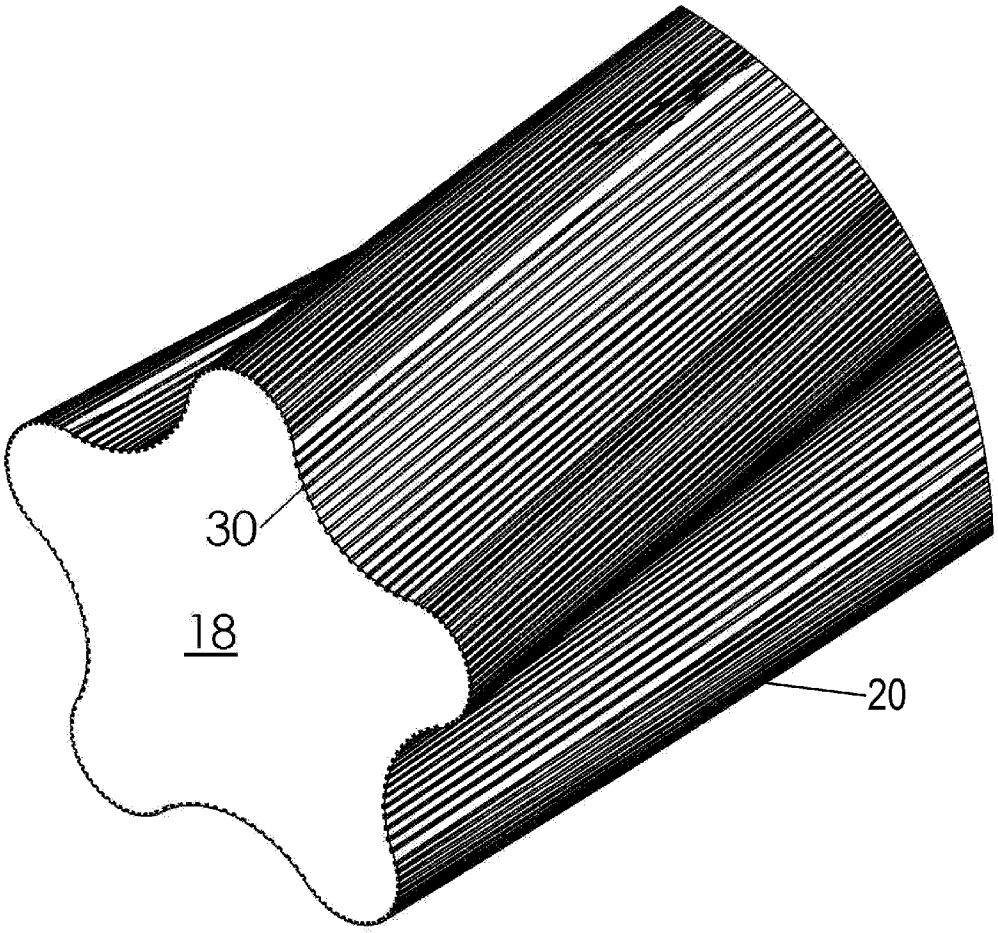
FIG. 11 illustrates spaced grooves on the rotor.

FIG. 11 illustrates grooves 30 each similar to that shown in FIG. 3 formed on a portion of the exterior surface of a rotor 18. The rotor grooves 30 may follow the contour of the rotor lobes, and may be configured according to the alternative groove designs disclosed herein. In some applications, it may be preferable to provide the grooves on the rotor rather than the stator, and in other applications the grooves may be provided on each of the rotor and the stator.

The grooves on the inner surface of the stator are elongate in that each groove has a length significantly greater than its width. Continuous grooves may be formed along substantially the entire length of the stator housing, or a discrete length axially extending groove may be formed, followed by a short interval of no groove, followed by a continuation discrete length axially extending groove, etc. Each groove may have one outwardly slanted side wall, and a "straight" side wall which is substantially perpendicular to the interior surface of the stator. In another alternative, both the side walls of the groove may be tapered outwardly, but at different angles relative to a centerline of the groove.

Each axially extending groove which matches or follows the contour of a respective lobe on the stator or the rotor will be a substantially uniform spacing from a respective lobe centerline. The spacing between elongate grooves is relatively short so that the lands between the grooves (e.g., the interior surface of stator not having a groove) for a preferred embodiment may occupy from two to ten times the surface area of the grooves.

The benefits of the invention may be realized because downhole application systems use better filtering techniques than in decades past for recovering solid particles before the fluid enters the pump/motor. In some applications, for example, water may be used as a working fluid when drilling out plugs in a well. Also, some applications utilize a higher viscosity working fluid than was used a decade ago, and accordingly this higher viscosity fluid further benefits from the use of grooves as disclosed herein to disrupt fluid flow to the gap between the rotor and the stator.

The pump/motor can become locked by particles wedged between the rotor and the stator if the particles passing through the pump/motor are larger than the gap. Decreasing the gap between the rotor and the stator reduces the amount of "lost" fluid which passes through the gap, but increases the likelihood of solid particles becoming wedged between the rotor and the stator. The addition of fluid flow disrupting grooves reduces this lost fluid while maintaining a sufficient gap between the rotor and the stator of a progressing cavity pump/motor to minimize or eliminated locking. Costs are incurred to provide such grooves in a progressing cavity pump/motor compared, for example, to providing a spaced groove surface and gap between a cylindrical shaft with a uniform diameter and a uniform diameter bore in a housing. Unlike other situations, the spacing between a groove and the ever changing gap location varies as the pump/motor is operated. Moreover, providing grooves along the contoured surface of a lobe is more complicated, particularly since the grooves effectively need to be provided over substantially the entire length of the pump/motor, which may be twenty feet or more in length. Grooves in the rotor and the stator may be formed using machining techniques which are commonly used to form the respective lobes on the rotor and/or on the stator.

The progressing cavity pump/motor of the present invention includes a stator with a substantially rigid interior surface in the form of spiraling internal lobes, and a rotor with a substantially rigid external surface and one or more spiraling external lobes. At the temperatures and pressures in which the pump/motor is operating, these surfaces are substantially rigid. As used herein, "substantially rigid" means a surface of any material with sufficient geometric stability at its operating temperature and pressure such that the flexibility of the surface does not create or contribute to sealing or to reduced loss of the working fluid between the surfaces. This includes pliable or elastic materials which "cure", "set", or "age" to meet the definition of "substantially rigid" under operating conditions.

The "lands" or spacing between the grooves allow the interior surface of the stator to act as a guide to facilitate rotation of the rotor within the stator. Accordingly, these surfaces cyclically engage at several locations along the length of the pump/motor to guide rotation of the rotor within the stator. A contact seal is not achieved apart from these specific locations. Grooves, at intervals along each of the respective lobes, are provided on the interior of the stator or on the exterior of the rotor to minimize fluid losses through the gap by generating turbulence and effectively reducing the gap width. Groove depth may vary from 0.001 inches to 0.100 inches.

A metal stator and rotor may be formed from steel, since it is a suitable substantially rigid material, although composite materials and some thermoset materials also have this substantially rigid feature, and also provide high chemical resistance to various types of downhole fluids. The gap between the rotor and the stator may vary from 0.000 inches to a point of maximum cavity width. Lost fluid passing through this gap is significantly reduced by the use of grooves as disclosed herein.

The addition of grooves in the surface of the stator or rotor reduces the loss of working fluid passing through the pump/motor, thereby increasing efficiency. In other applications, the size of debris in the working fluid mandates a large gap between the rotor and stator, such that the efficiency of the pump/motor becomes unattractive. By providing the grooves as disclosed herein, a sufficiently large gap may be maintained to pass sizable debris while still resulting in a pump of reasonable efficiency.

The pump/motor disclosed herein is particularly well-suited for downhole applications, e.g., in oil and gas drilling and fluid recovery operations. The pump/motor has significant benefits in other applications, particularly in applications involving high temperature environments and/or fluids deleterious to elastomers.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A progressing cavity pump/motor, comprising:

a stator having an interior surface with two or more spiraling lobes;

a rotor having an exterior surface with one or more spiraling lobes, the one or more lobes of the rotor cooperating with the two or more lobes of the stator to form progressing cavities between the stator and the rotor during rotation of the rotor within the stator; and a plurality of spaced grooves formed on a portion of a spiraling lobe on at least one of the stator interior surface and the rotor exterior surface to disrupt the flow of fluid flowing through a gap between the stator interior surface and the rotor exterior surface to reduce fluid leakage between the stator and the rotor;

wherein ach of the plurality of spaced grooves is parallel to a centerline of the spiraling lobe on which the spaced groove is formed.

2. The progressing cavity pump/motor of claim 1, wherein at least one of the plurality of spaced grooves comprises a stepped groove with a first portion having a shallower depth than an adjacent second portion.

3. The progressing cavity pump/motor of claim 1, wherein at least one of the plurality of spaced grooves has a curvilinear cross-sectional configuration.

4. The progressing cavity pump/motor of claim 1, wherein the plurality of spaced grooves are provided in sets of two or more differently configured grooves, with a respective land between adjacent groove sets.

5. The progressing cavity pump/motor of claim 1, wherein a land between adjacent grooves or sets of grooves has a width that is within the range of 0.1 to 1.2 inches.

6. The progressing cavity pump/motor of claim 1, wherein the plurality of spaced grooves are formed on the interior surface of the stator.

7. The progressing cavity pump/motor of claim 1, wherein each of the plurality of grooves has a depth from an adjacent land that is within the range of 0.001 inches to 0.100 inches.

8. A progressing cavity pump/motor, comprising:

a stator formed having an interior surface and two or more spiraling internal lobes;

a rotor having an external surface and one or more spiraling external lobes, the rotor cooperating with the stator to form progressing cavities between the stator and the rotor during rotation of the rotor; and at least one of the stator interior surface and the rotor exterior surface having a plurality of spaced grooves, each of the plurality of spaced grooves being parallel to a centerline of the respective spiraling lobe on which the spaced grooves are formed to disrupt the flow of fluid flowing to a gap between the stator and the rotor to reduce fluid leakage between the stator and the rotor.

9. The progressing cavity pump/motor of claim 8, wherein at least one of the plurality of spaced grooves is a stepped groove with a first portion having a shallower depth than an adjacent second portion.

10. The progressing cavity pump/motor of claim 8, wherein at least one of the plurality of spaced grooves has a curvilinear cross-sectional configuration.

11. The progressing cavity pump/motor of claim 8, wherein each of the plurality of grooves has a groove depth from the respective surface within the range of 0.001 inches to 0.100 inches.

12. The progressing cavity pump/motor of claim 8, wherein a surface spacing between one of adjacent grooves and adjacent sets of grooves is within the range of 0.1 to 1.2 inches.

13. The progressing cavity pump/motor of claim 8, wherein the plurality of spaced grooves are formed on the interior surface of the stator.

14. The progressing cavity pump/motor of claim 8, wherein the plurality of spaced grooves are formed on the exterior surface of the rotor.

15. A stator for a progressing cavity pump/motor including a rotor having a rigid external surface and one or more spiraling external lobes, the rotor cooperating with the stator to form progressing cavities between the stator and the rotor during rotation of the rotor within the stator, the stator comprising:

an interior surface and two or more spiraling internal lobes; and a plurality of spaced grooves to disrupt the flow of fluid flowing through a gap between the interior surface of the stator and the exterior surface of the rotor to reduce fluid leakage between the stator and the rotor;

wherein each of the plurality of spaced grooves is parallel to a centerline of a stator spiraling lobe.

16. The stator of claim 15, wherein at least one of the plurality of spaced grooves comprises a stepped groove with a first portion having a shallower depth than an adjacent second portion.

17. The stator of claim 15, wherein each of the plurality of grooves has a groove depth from the respective surface of from 0.001 inches to 0.100 inches.

18. The stator of claim 15, wherein at least one of the plurality of spaced grooves has a curvilinear cross-sectional configuration.

* * * * *